US006604846B2

(12) United States Patent
Strickland

(10) Patent No.: US 6,604,846 B2
(45) Date of Patent: Aug. 12, 2003

(54) COLLAPSIBLE LAMP SHADE

(76) Inventor: Jerry Strickland, 3506 Airport Rd., Jonesboro, AR (US) 72403

( * ) Notice: Subject to any disclaimer, the term of this patent is extended or adjusted under 35 U.S.C. 154(b) by 0 days.

(21) Appl. No.: 09/854,443

(22) Filed: May 14, 2001

(65) Prior Publication Data

US 2002/0167812 A1 Nov. 14, 2002

(51) Int. Cl.[7] ..... F21V 1/06

(52) U.S. Cl. ..... 362/352; 362/450; 135/33.4; 135/33.41; 403/232.1

(58) Field of Search ..... 362/352, 450; 403/232.1; 135/33.4, 33.41

(56) References Cited

U.S. PATENT DOCUMENTS 2,538,676 A * 1/1951 Enright ..... 362/352
2,884,515 A * 4/1959 Fogel ..... 362/352
3,435,205 A * 3/1969 Paul ..... 362/352
4,354,222 A * 10/1982 Gall ..... 362/352
5,375,048 A * 12/1994 Barnes ..... 362/352
6,315,434 B1 * 11/2001 Long ..... 362/352
6,386,739 B1 * 5/2002 Wu ..... 362/450

* cited by examiner

*Primary Examiner*—Sandra O'Shea
*Assistant Examiner*—Ismael Negron
(74) *Attorney, Agent, or Firm*—Dennis B. Haase

(57) ABSTRACT

A selectively collapsible lamp shade in which the shade is extended between upper and lower rings, the rings being held apart by a series of struts which are transverse to and engage the rings in a series of equidistant supports about the perimeter of the shade. The struts are pre formed to define the shape of the shade and inhibit improper installation of the struts.

12 Claims, 1 Drawing Sheet

COLLAPSIBLE LAMP SHADE

The present invention relates generally to lamp shades, and more particularly, to a lamp shade which is readily assembled by an average consumer and equally collapsible into an essentially planer item for shipping and handling.

BACKGROUND OF THE INVENTION

Field of the Invention

The venerable light shade has been a household staple since the memory of man runneth not to the contrary. Indeed, such devices predate Edison's invention of the light bulb, when they were used to disperse and soften candle light. They come in all shapes and sizes, are both utilitarian and decorative, and while typically three dimensional and bulky, weigh relatively little.

Lamp shades, until recently, have been typically shipped fully assembled, and, while it is sometimes possible to ship several in stacked relation, the shipping container is both bulky and cumbersome. The manufacture of lamp shades has become extremely competitive, and, as a consequence, the cost of manufacture, which includes shipping the product to the seller's point of sale, all becomes a significant factor in this highly competitive market place.

With the commercial maturation of the Pacific Rim and, in particular, China, much of the demand for production of lamp shades has migrated in that direction, based primarily on cost factors. However, shipping costs have coincidently become a significant factor and such costs are dependent, in addition to weight, on the volume of the shipping container. Since, in the case of a lamp shade, weight is less of a factor than bulk, any savings that can be realized in the reduction of the volume of a shipment becomes significant in the cost to get the product into the hands of the reseller.

Overview of the Prior Art

The prior art is replete with a staggering variety of shades which transcend the generations, reaching back to pre electricity days when such shades were used to shield one's vision from glare by dispersing light from, for example, a candle, or perhaps an oil lantern. See Watanabe U.S. Pat. No. 1,178,764 by way of example.

The more common strut is a wire, which extends between the upper and lower support members, and there is a line of patents, perhaps the grandfather of which, is Stearns U.S. Pat. No. 351,717. In that effort, a wire is bent about a lower ring and is hooked at the top so as to receive an upper support in the form of a circular slat.

Okamoto U.S. Pat. No. 3,023,307 is a variation on this theme in which Okamoto employs a ring receiver soldered, or otherwise attached, to the ends of the wire, which is adapted to receive the ring. Such an arrangement permits the wires to be moved anywhere on the ring, and spacing of the wires becomes difficult. Moreover, the wires are prone to becoming deformed, thus adversely effecting the shape of the shade. Stadler U.S. Pat. No. 2,037,941 is similar in concept with the receiver being somewhat modified.

In other patents, such as Tradelius U.S. Pat. No. 2,702,341, form holes in the sides of upper and lower members and bend the ends of the wire supports inwardly or outwardly to fit into the holes. Perhaps the most common means of connection is to provide tubes which are attached to the upper and lower rings and into which supports can be fitted. Exemplary of such structures is Barnes U.S. Pat. No. 5,375,048, which also uses a hinge to assist in the collapsability. Additionally, see Gall U.S. Pat. No. 4,354,222 and Kaufman U.S. Pat. No. 1,319,092, which provides a historical perspective, and German patent number 401,783.

Each, every and all of the foregoing efforts at providing a collapsible lamp shade are unnecessarily complex in their design and an effort to distinguish from the competition without accomplishing a viable improvement.

SUMMARY OF THE INVENTION

The present invention, while not the first and only shade of its type to be collapsible, is certainly the most innovative and practical to reach the market. The shade comprises a lamp shade having selectively shaped struts that are removable for shipping and storage and insertable to erect the shade for use.

It is an objective consonant with the foregoing to provide a lamp shade that is capable of assuming a planer configuration for shipping and handling, while being easily assembled into a decorative shade for use.

An objective, similar to the foregoing, is to provide a collapsible lamp shade that is readily assembled by almost anyone, even with no prior experience, into an attractive and very functional shade. Yet another objective of the present invention is to provide a lamp shade of the character described in which the struts are pre shaped to obviate the prospect of their being installed improperly.

Still other objectives and advantages of the present invention will become apparent from a reading of the following detailed description, taken in conjunction with the drawings, wherein:

DETAILED DESCRIPTION OF A PREFERRED EMBODIMENT

Figure 1:
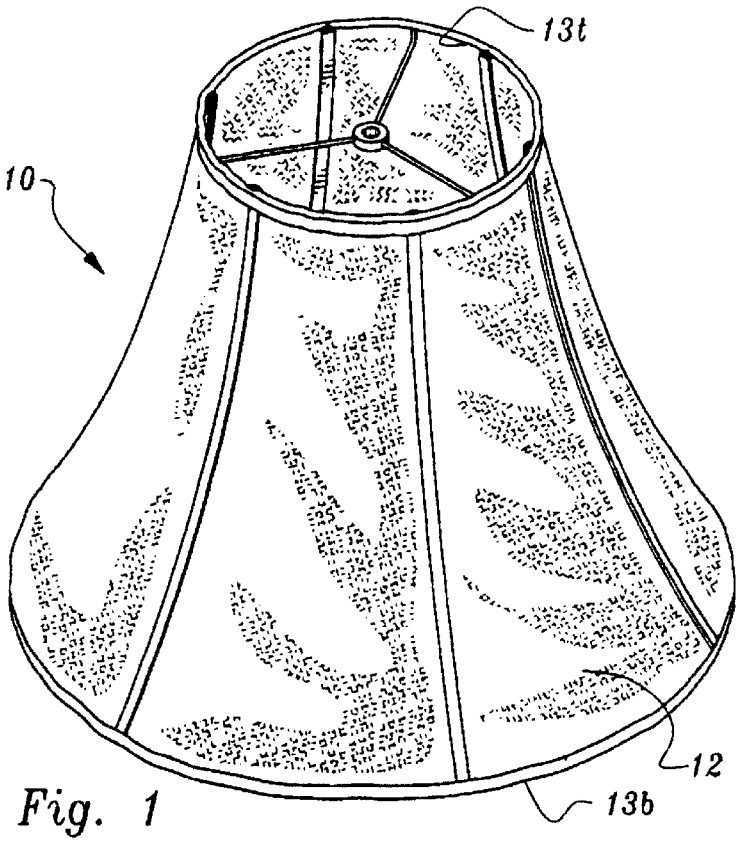
FIG. 1 is a pictorial representation of a lamp shade constructed in accordance with the present invention.

With reference now to the drawing, and at least initially to FIG. 1, there illustrated in significant detail is a highly decorative, assembled lamp shade 10, constructed in accordance with the present invention.

The lamp shade 10 comprises a shade, or cover portion, 12 which is made of any suitable material which is readily shaped or capable of conforming to a predetermined shape. Many fabric materials are in frequent use and even certain paper materials may also be suitable in appropriate instances.

In a typical instance, the shade is a closed loop of translucent material. As illustrated by way of example, the shade of the present invention has been shaped to define a generally cylindrical piece of material that appears, when viewed in profile, to be in a truncated conical shape, although it will be appreciated that the precise shape may vary significantly from a straight edge to a variety of softly curved surfaces.

In most cases, however, and in the illustrated case, the shade portion is formed with an opening 13*t* at the top and a complimentary opening 13*b* at the bottom and is generally, although not necessarily, smaller at the top than at the bottom. The shade is, in accordance with the invention, formed with a series of strips of piping which extend lengthwise of the shade and are spaced equidistant about the perimeter of the shade.

The shade portion, in its assembled state, is extended, or stretched, between an upper support 14 in the form of a ring, and a lower support, or base member, 16, also in the form of a ring. The rings are formed to define the axial shape of the shade. It will be understood that the geometric shape of the upper and lower support members are complimentary and, while the upper support may be smaller in dimension than the lower support member, the shape is essentially the same. Further, the rings, when the shade is assembled, are generally parallel to one another.

The shade portion is fastened, at its respective ends, to the supports, such as by circumscribing the material at the respective open ends of the shade by sewing the material at the open ends about the circumference of the openings about the rings, thereby forming a hem. Needless to say, that attachment may be effected in other ways without departure from the invention.

Figure 3:
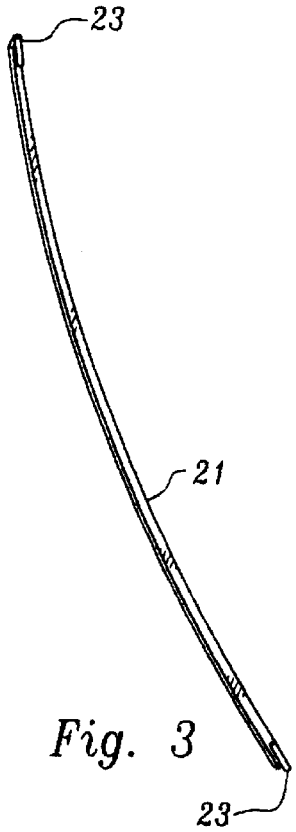
FIG. 3 is a depiction of the strut of the shade of the present invention, illustrating its shape; and, FIG. 4 is an exploded, partially sectioned view illustrating the interrelationship between the ring 16 and a strut 21, and, specifically, demonstrating how the strut engages the ring to form the framework of the shade.

The essence of the invention is its ability to be collapsed into an essentially planer package for shipping and handling, while readily assembled for use, and, to this end, a series of essentially identical struts 21 are provided, as seen in FIG. 3. Each of the struts is constructed of a flat strap of spring like, preferably metallic, material which is capable of being pre stressed into a predetermined shape, and has memory once shaped.

Each strut is fully removable and selectively mountable between the upper and lower supports, and, for this purpose, each is formed with a nib 23, at opposed ends thereof, and, of course, removable to collapse the shade for shipping. Each strut is preferably of a length that is less than the diameter of the larger ring and is, thus, nestable within the rings when the shade is collapsed to minimize the depth of the package for shipping.

In order, in keeping with the objectives of the invention, that even the most inexperienced person can correctly assemble the lamp shade for use, each strut is formed, in any suitable manner, to define the desired profile of the lamp shade, and misassembly of the lamp shade will be, therefore, made immediately apparent to even the most casual observer, and extremely difficult to perform.

Figure 2:
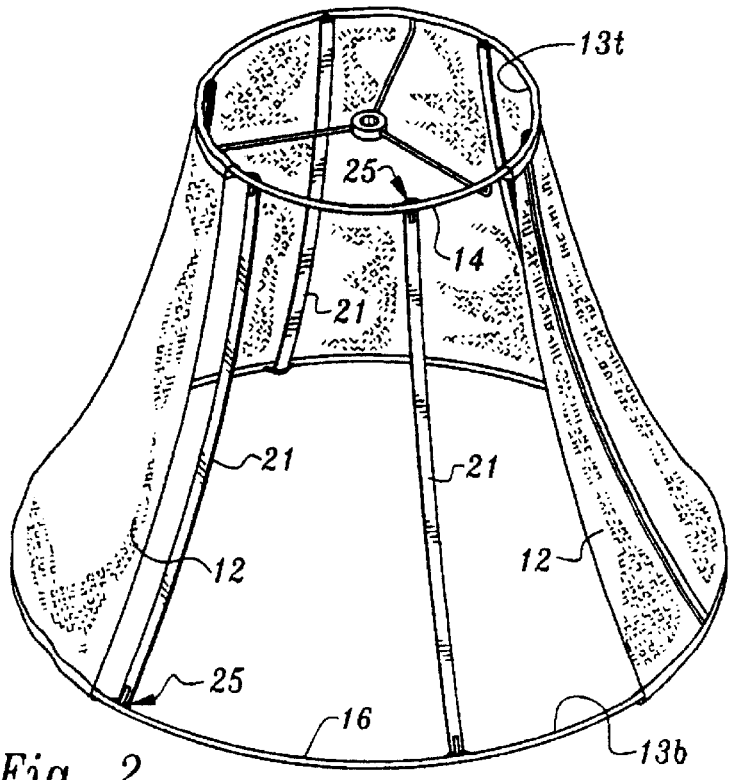
FIG. 2 is a view, similar to FIG. 1, partially sectioned to depict the attachment of the struts to erect the shade.
Figure 4:
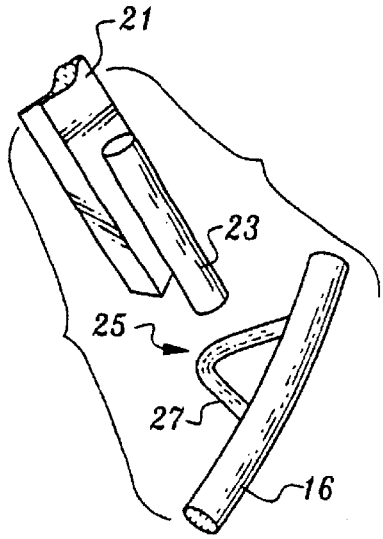

Referring next to FIG. 2, in this preferred embodiment, each end of each strut is received in a retainer 25 formed on, or contiguous with, the upper and lower supports 14 and 16. The retainer 25 may take any number of forms without departure from the essence of the invention. For example, a loop 27 may be formed either of fabric, plastic or metal as the situation commands, and is attached, preferably to the support members by sewing, solder, or in some other appropriate manner, which creates a loop that is sufficient in size and strength to receive a nib of a strut.

The struts are spaced about the perimeter of the shade, preferably circumferentially equidistant, in a series and are aligned transverse to the support members to which they attach.

Further, in keeping with the objectives of the invention, the struts are positioned so as to be overlaid by the piping on the shade itself. By so doing, the presence of struts is effectively hidden from view, thereby giving the pleasing illusion, when the light is on, that there are no struts supporting the upper and lower rings.

Having now described a preferred embodiment of the present invention, variations in the structure and assembly of elements will occur to those skilled in the art, without departure from the essence of the invention, which is claimed, as follows:

What is claimed is:

1. A selectively collapsible lamp shade, including a shade portion; an upper ring; a lower ring, said rings being parallel to one another when said lamp shade is assembled; a series of removably mountable struts, said struts extending between said lower ring and said upper ring and together with said rings defining a framework for said lamp shade; said shade portion comprising a closed loop of material having substantially parallel edges, said shade portion being open at the respective ends thereof, said shade portion circumscribing said framework;

said struts being selectively engagable with said rings at opposed ends thereof to stretch said shade portion between said rings to define the shape thereof, said rings being formed with a series of circumferentially spaced retainers, said struts having nibs at each end thereof, and said nibs being fitted into said retainers and a respective end of each strut resting on top of a respective retainer to affix said rings in spaced relation.

2. The lamp shade of claim 1, wherein said shade portion is formed with a series of strips of piping disposed about the perimeter of said shade portion.

3. The lamp shade of claim 1, wherein said struts are pre shaped to define the profile of the lamp shade.

4. The lamp shade of claim 3, wherein said struts are formed of a flat spring like material.

5. The lamp shade of claim 1, wherein said struts are formed of a flat spring like material.

6. The lamp shade of claim 5, wherein each said ring is formed with a series of equally spaced circumferential retainers, said struts having nibs at the ends thereof, and said nibs being fitted into said retainers to erect said shade.

7. The lamp shade of claim 1, wherein said shade portion is formed with a series of strips of piping disposed about the perimeter of said shade portion.

8. The lamp shade of claim 7, wherein said strips of piping being disposed at equidistant intervals, and said struts being coplaner with said strips.

9. The lamp shade of claim 1, wherein said struts are completely removable, and storable within said rings for shipping and storage.

10. The lamp shade of claim 9, wherein said struts are pre shaped to define the profile of the lamp shade.

11. The lamp shade of claim 9, wherein said struts are formed of a flat spring like material.

12. The lamp shade of claim 9, wherein each said ring is formed with a series of equally spaced circumferential retainers, said struts having nibs at the ends thereof, and said nibs being fitted into said retainers to erect said shade.

* * * * *